US010227844B1

(12) United States Patent
Watson et al.

(10) Patent No.: US 10,227,844 B1
(45) Date of Patent: Mar. 12, 2019

(54) PRESSURE RESPONSE FRACTURE PORT TOOL FOR USE IN HYDRAULIC FRACTURING APPLICATIONS

(71) Applicant: Watson Well Solutions, LLC, Watford City, ND (US)

(72) Inventors: Roger Watson, Weatherford, OK (US); Nevin Dahl, Watford City, ND (US)

(73) Assignee: Watson Well Solutions, LLC, Watford City, ND (US)

( * ) Notice: Subject to any disclaimer, the term of this patent is extended or adjusted under 35 U.S.C. 154(b) by 233 days.

(21) Appl. No.: 15/168,216

(22) Filed: May 30, 2016

Related U.S. Application Data

(63) Continuation of application No. 14/034,823, filed on Sep. 24, 2013, now Pat. No. 9,353,599.

(60) Provisional application No. 61/724,412, filed on Nov. 9, 2012.

(51) Int. Cl.

| | |
|---|---|
| ***E21B 34/14*** | (2006.01) |
| ***E21B 34/10*** | (2006.01) |
| ***E21B 43/26*** | (2006.01) |
| ***E21B 23/04*** | (2006.01) |
| *E21B 34/00* | (2006.01) |

(52) U.S. Cl.
CPC ..... *E21B 34/103* (2013.01); *E21B 23/04* (2013.01); *E21B 34/14* (2013.01); *E21B 43/26* (2013.01); *E21B 2034/007* (2013.01)

(58) Field of Classification Search
None
See application file for complete search history.

(56) References Cited

U.S. PATENT DOCUMENTS

| | | | | |
|---|---|---|---|---|
| 3,499,487 | A * | 3/1970 | Barrington | E21B 23/006 166/237 |
| 4,134,454 | A * | 1/1979 | Taylor | E21B 34/10 137/629 |
| 2010/0252281 | A1* | 10/2010 | Telfer | E21B 21/103 166/386 |
| 2014/0000909 | A1* | 1/2014 | Neer | E21B 34/108 166/373 |
| 2014/0048271 | A1* | 2/2014 | Coon | E21B 34/102 166/308.1 |

FOREIGN PATENT DOCUMENTS

WO 2012037646 3/2012

* cited by examiner

*Primary Examiner* — Shane Bomar
*Assistant Examiner* — Steven A MacDonald
(74) *Attorney, Agent, or Firm* — Gable Gotwals

(57) ABSTRACT

A pressure response fracture port tool and method for its use reliably provides a noticeable indication at surface to an operator as to when the flow port is opened. The tool includes an outer housing and a sliding sleeve which resides within the outer housing. The outer housing has a first and second set of flow ports. The inner mandrel moves between a first position and a third position to expose the flow ports to the wellbore. The first set of flow ports, with its smaller area relative to the second set of flow ports, creates a noticeable pressure increase or spike that can be observed at surface when exposed to the wellbore. The second set of flow ports creates a noticeable pressure drop when it is exposed to the wellbore.

13 Claims, 3 Drawing Sheets

PRESSURE RESPONSE FRACTURE PORT TOOL FOR USE IN HYDRAULIC FRACTURING APPLICATIONS

CROSS REFERENCE TO PENDING APPLICATIONS

This application is a continuation of U.S. patent application Ser. No. 14/034,823 filed Sep. 24, 2013, now U.S. Pat. No. 9,353,599, which claims priority to U.S. Prov. Pat. Appl. Ser. No. 61/724,412, filed on Nov. 9, 2012.

BACKGROUND OF THE INVENTION

This invention relates generally to hydraulic fracturing and, more particularly, to downhole tools and methods used in the sliding sleeve method of hydraulic fracturing.

Hydraulic fracturing creates fractures in a reservoir rock formation in order to release oil and natural gas products from that formation. The two most common methods of creating the fractures are the "plug" method (or "plug-and-perf" method) and the "sliding sleeve" method.

One of the challenges with the sliding sleeve method is the occasional failure of the ball to reach or seat properly in the sliding sleeve of the next flow port or zone and, therefore, not open that fracture zone. The operator in the fracking rig often cannot tell if the flow port is open because formation characteristics vary along the wellbore, thereby making pressure readings difficult, if not impossible, to interpret. Therefore, the operator has no consistent indication that the fracture zone is actually open. Electronic sensors can be run along with the flow ports, but this is expensive and takes more time to install with more risk in deployment.

The lack of a clear indication that the zone is open does not happen on all port opening events, but does occur on some events throughout the process of fracturing along the length of the entire wellbore. This lack of opening indication can result in the hydraulic fracturing process being shut down to investigate if the next fracture zone of interest is actually opened. In cases in which the ball did not reach the next flow port, it is possible for one zone to be completely skipped in the fracturing process. If the zone is not open and fracture fluid continues to pump, then the zone prior to the zone of interest will receive additional fracture fluid. This additional fracture fluid could cause formation damage, reach into unwanted saltwater zones, and impede well production. In some cases, this can cause significant monetary losses.

Therefore, there is a need to improve the reliability of the sliding sleeve method so that an operator knows, with a high degree of certainty, that the ball has reached the fracture zone of interest and has opened up that zone.

SUMMARY OF THE INVENTION

A pressure response fracture port tool ("the tool") made according to this invention reliably provides a noticeable indication at surface to an operator as to when the flow port is opened. The tool includes an outer housing and a sliding sleeve which resides within the outer housing. The outer housing has a first and second set of flow ports. The inner mandrel moves between a first position and a third position to expose the flow ports to the wellbore.

The first set of flow ports, with its smaller area relative to the second set of flow ports, creates a noticeable pressure increase or spike that can be observed at surface when exposed to the wellbore. The second set of flow ports creates a noticeable pressure drop when it is exposed to the wellbore. "Exposed to the wellbore" means that the inner mandrel is no longer blocking fluid flow to the first set (and then second set) of flow ports of the outer housing.

After the pressure spike and drop are observed, the operator is assured that the fracture zone of interest is now open and flow downstream of the tool is blocked. The pump rate can be increased and the zone can be hydraulic fractured.

Objects of this invention are to provide a pressure response flow port tool that (1) makes the sliding sleeve method of hydraulic fracturing more reliable than prior art tools which are used for that purpose; (2) increases the likelihood of a proper hydraulic fracturing job along the entire length of the wellbore; (3) provides a noticeable, unambiguous indication to an operator that the fracture zone is open; (4) artificially creates a pressure spike and subsequent pressure drop so that, independent of the formation's characteristics, the pressure spike and drop are noticeable to an operator; and (5) does not require significant changes to be made to current hydraulic fracturing methods or procedures.

ELEMENTS, NUMBERING AND LABELING USED IN THE DRAWINGS AND DETAILED DESCRIPTION

Figure 1:
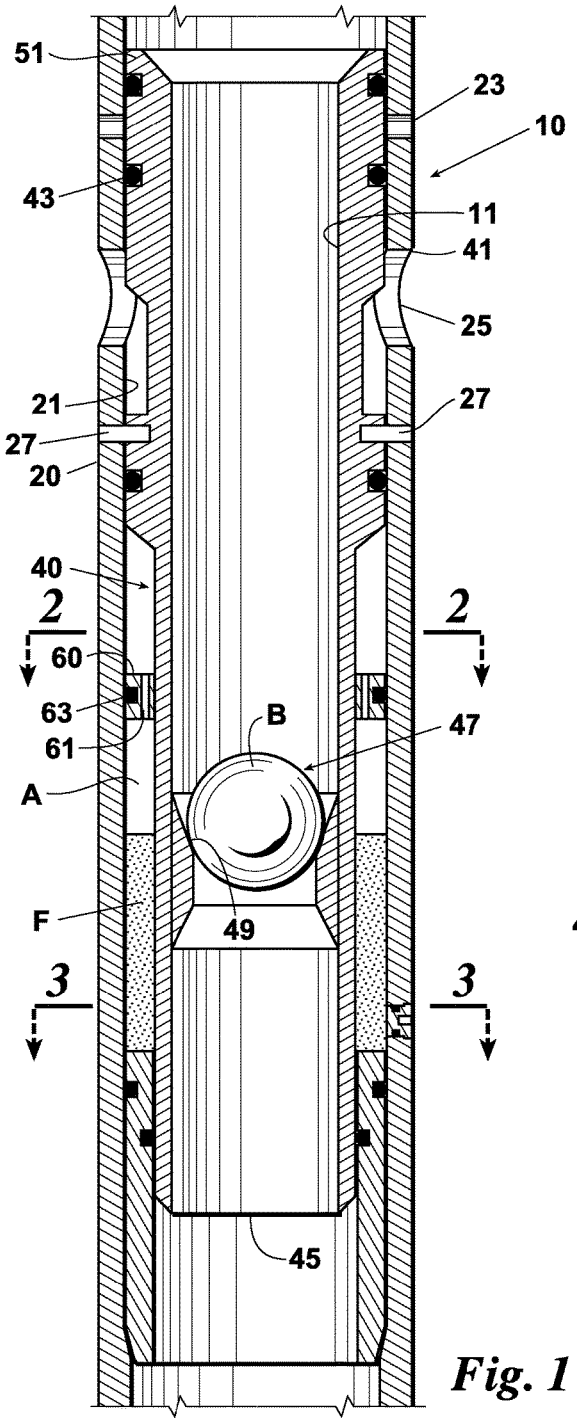
FIG. 1 is a front elevation view of a preferred embodiment of a pressure response fracture port tool ("the tool") made according to this invention as it appears inside the casing or formation (not shown) of a horizontal wellbore. The tool is in its first position, with a set of shear pins holding the sliding sleeve or inner mandrel in a fixed position relative to the outer housing and the ball being initially received by the profile or seat of the tool. In this first position, the fracture zone of interest is closed, with the inner mandrel covering the flow ports of the outer housing and preventing fracturing fluid from being exposed to the wellbore.
Figure 2:
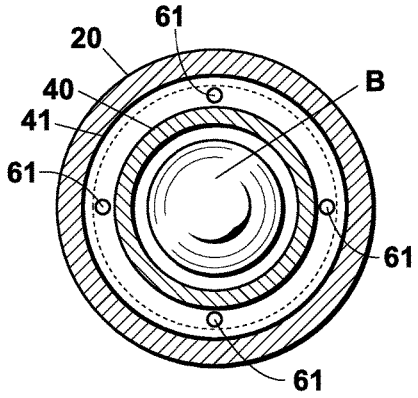
FIG. 2 is a cross-section view taken along section line 2-2 of FIG. 1. A containment ring with a set of bypass holes is located between the fluid medium below (i.e., downstream of) the ring and an air medium above the ring.
Figure 3:
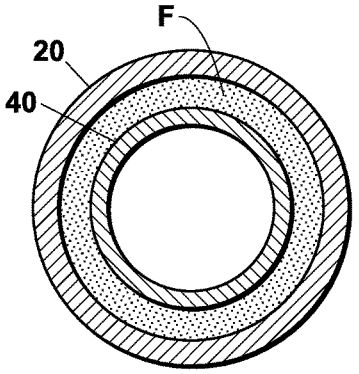
FIG. 3 is a cross-section view taken along section line 3-3 of FIG. 1. The fluid medium resides between the outer housing of the tool and the inner mandrel. The inner mandrel meters through the fluid medium to provide a predetermined time period in which the first set of flow ports become exposed to the wellbore (see FIG. 4) and the second set of flow ports become exposed (see FIG. 7).

10 Pressure response fracture port tool 10
11 Inner diameter of 10
20 Outer housing
21 Inner wall of 20
23 First set of flow ports
25 Second set of flow ports
27 Shear pins
40 Sliding sleeve or inner mandrel
41 Outer wall of 40
43 O-ring seal
45 Forward (downstream) end
47 Profile
49 Seat
51 Rearward (upstream) end
60 Containment ring
61 Bypass holes
63 O-ring
A Air gap
B Ball
F Fluid medium

DETAILED DESCRIPTION OF THE PREFERRED EMBODIMENTS

Figure 4:
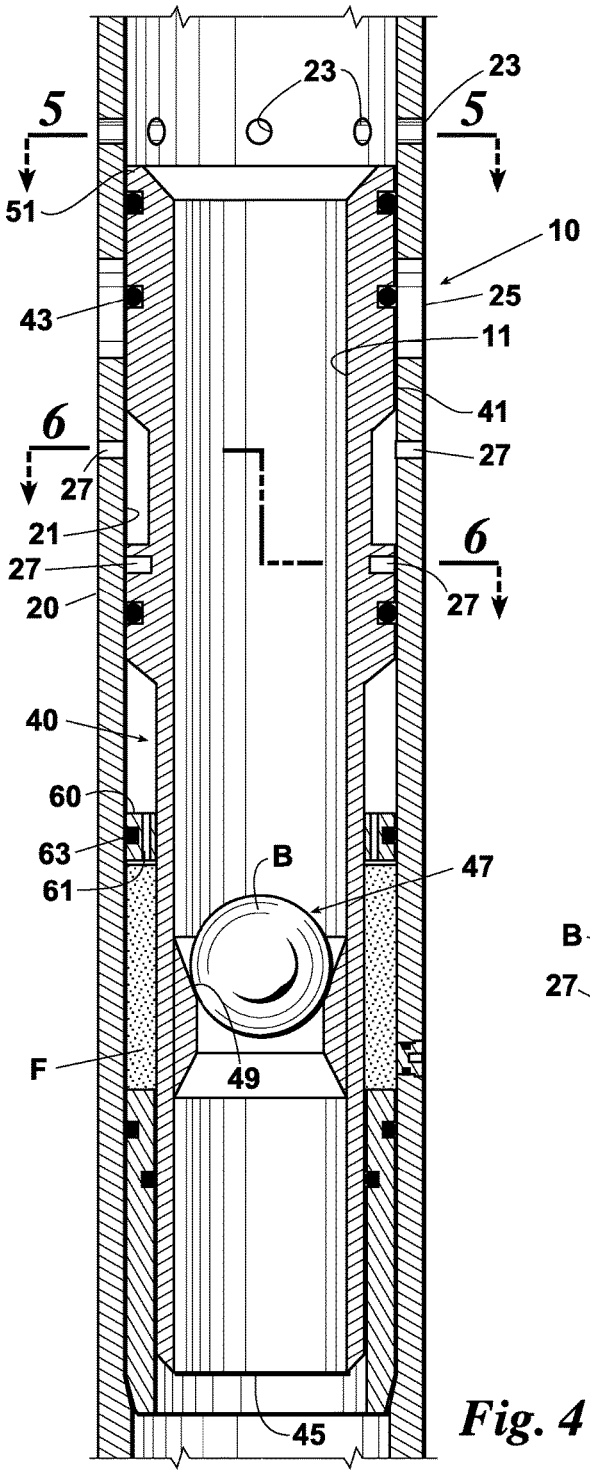
FIG. 4 is a front elevation view of the tool of FIG. 1 in its second position. The hydraulic fracturing fluid impinges upon the ball, causes the shear pins to shear, and the inner mandrel to slide or move downward in response to expose the first set of flow ports.
Figure 5:
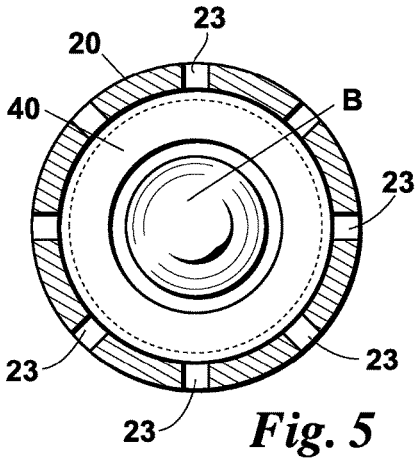
FIG. 5 is a cross-section view taken along section line 5-5 of FIG. 4. As the inner mandrel moves downward into the second position, exposure of the first set of flow ports to the wellbore causes a noticeable pressure spike observed on the pressure sensors at surface.
Figure 6:
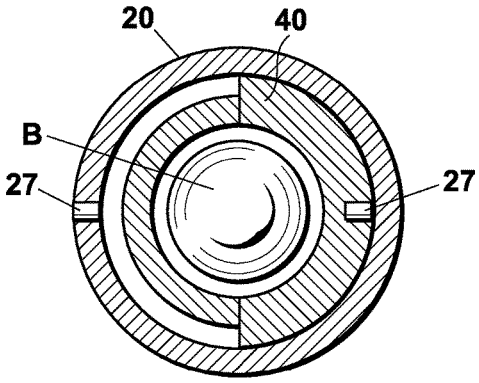
FIG. 6 is a cross-section view taken along section line 6-6 of FIG. 4.
Figure 7:
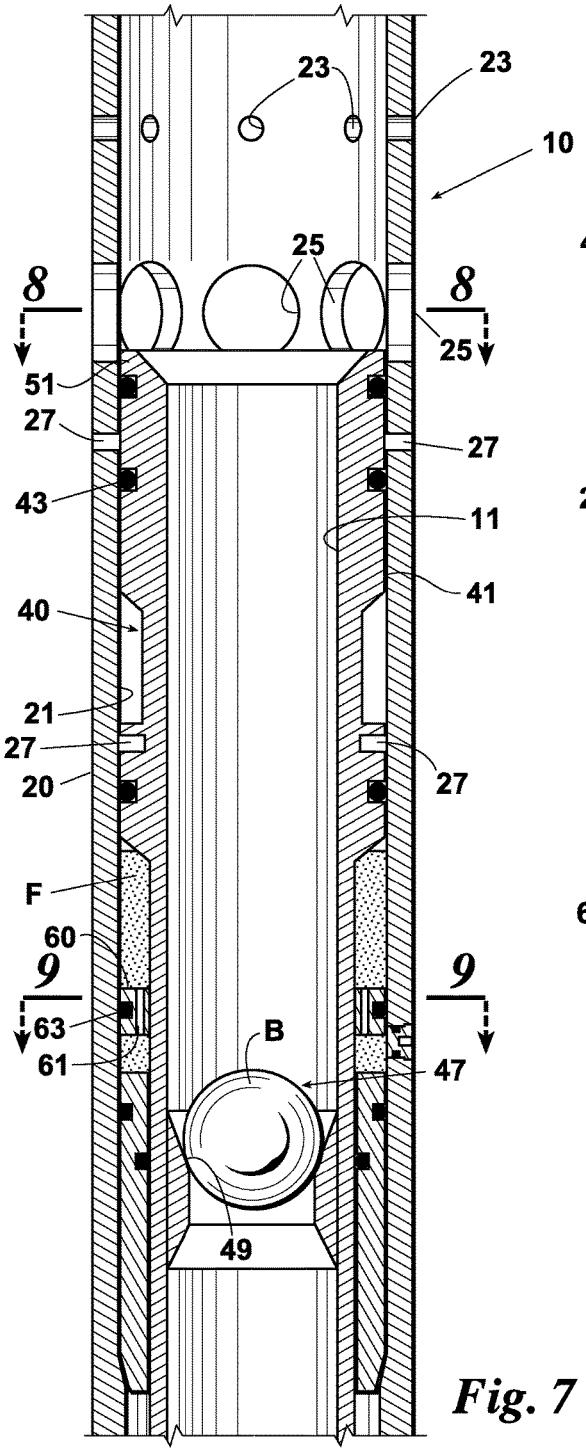
FIG. 7 is front elevation view of the tool of FIG. 1 in its third position, thereby completely opening the fracture zone. Alternate embodiments of the tool could include more than three positions but, at a minimum, the tool would include three positions (closed, pressure spike, pressure drop).
Figure 8:
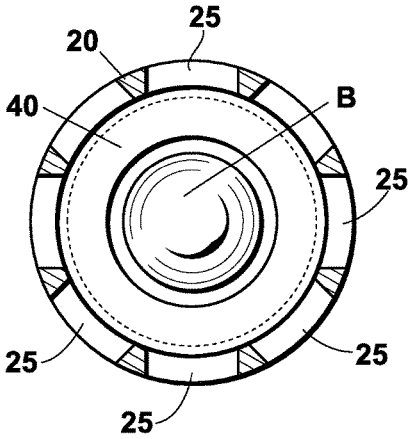
FIG. 8 is a cross-section view taken along section line 8-8 of FIG. 7. As the inner mandrel continues to move downward and meter through the fluid medium, a second set of flow ports in the housing is exposed to the inside of the wellbore. This exposure causes a noticeable pressure drop.
Figure 9:
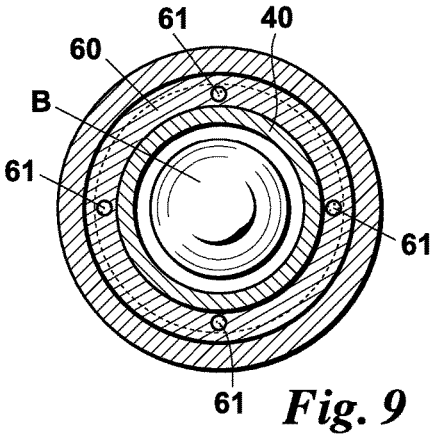
FIG. 9 is a cross-section view taken along section line 9-9 of FIG. 7. A portion of the fluid medium has metered through the containment ring and done so in such a way that the first set of flow ports is exposed to the wellbore for a predetermined amount of time before the second set of flow ports is exposed.

Referring to the drawings, a pressure response fracture port tool ("the tool") 10 made and used according to this invention includes an outer housing 20 having a first and second set of flow ports 23, 25 (see FIG. 1) and a sliding sleeve or inner mandrel 40 which initially covers the ports 23, 25 and then exposes each set of flow ports 23, 25 in turn (see FIGS. 4 & 7).

"Exposed to the wellbore" means that the inner mandrel is no longer blocking fluid flow to the first set (and then second set) of flow ports of the outer housing.

The inner mandrel 40 is initially held in relation to the outer housing 20 by a set of shear pins 27 so that in a first position the mandrel 40 covers the first and second set of flow ports 23, 25 located in the outer housing 20. O-ring type seals 43, of a kind well known in the art, provide sealing engagement between the inner wall 21 of the housing 20 and the outer wall 41 of the inner mandrel 40.

When the tool 10 is deployed downhole in this first position, the fracture zone of interest is closed and fracturing fluid entering the tool 10 is prevented from being exposed to the wellbore. A profile 47 located toward the forward (downstream) end 45 of the inner mandrel 40 receives a ball "B" used to block flow downstream of the zone of interest. The portion of inner mandrel 40 located toward its rearward (upstream) end 51 blocks the set of flow ports 23, 25.

A predetermined pump rate is established prior to the anticipated seating of the ball B in the tool 10. Once the ball B is seated in the profile 47 of the tool 10, flow is closed off to well casing downstream of the tool 10 and fluid pressure increases inside the inner diameter 11 of the tool 10. As this change in pressure is established, the ball B in the seat 49 travels down at a controlled rate due to the pressure above the seated ball B being greater than the pressure below the seated ball B.

The set of shear pins 27 holding the inner mandrel 40 stationary shear once the pressure difference reaches a predetermined threshold, thereby freeing the inner mandrel for movement. For example, the shear pins 27 may be designed to shear at about 2,000 psi.

The now-freed inner mandrel 40 first meters through an air gap "A" and then meters through a fluid medium "F" located below the air gap A and a containment ring 60 (see e.g., FIG. 1). The containment ring 60 includes bypass holes 61 which allow any displaced fluid medium F to flow through and above the ring 60. An O-ring 63 provides sealing means between the ring 60 and the inner wall 21 of the outer housing 20.

The air gap A is sized so that the inner mandrel 40 travels the distance required to uncover the first set of flow ports 23, which are located in the outer housing 20 of the tool 10, without encountering any resistance to its travel. The fluid medium F slows the travel of the inner mandrel 40 and is sized so that the inner mandrel 40 travels the distance required to uncover the second set of flow ports 25 of the outer housing 20. Travel through the fluid medium F occurs in a predetermined amount of time measured from when the first set of flow ports 23 become exposed.

The first set of flow ports acts 23 to restrict the fracture fluid flow and cause a fluid pressure increase or spike within the well casing. This pressure spike, which is noticeable to an operator in a fracking rig and which can be detected by pressure sensors and means well known in the art, is preferably in a range of about 100 to 200% above the ambient pressure established by pump psi and rate. The operator sees the spike occur and now knows the ball B has seated in the tool 10 downhole.

When the second set of flow ports 25 becomes exposed to the wellbore, a pressure drop occurs because the flow area through the tool 10 is the same (or about the same) as that through the first and second set of ports 23, 25 combined. This pressure drop, which is noticeable to the operator and which can also be detected by pressure sensors and means well known in the art, indicates that the fracture zone of interest is open. The pump rate can be increased and the zone can be hydraulic fractured. This pressure change occurs in a continuous well stimulation process where the fracturing pressure pumps do not stop but change their rate of pumping (bpm), thus allowing for time savings and efficiency.

The fracture zone stays open after the zone has been fractured and the next ball B is deployed. This next ball B is seated in the profile 47 of the next tool 10 upstream from the tool 10 in the zone just fractured, thereby cutting off the flow of fluid to this just-fractured zone. The process repeats itself until the wellbore has been hydraulic fractured to its predetermined capacity.

Once the inner mandrel 40 exposes the second set of flow ports 25 of the outer housing 20, the flow area from the tubular inner diameter 11 through the tool 10 is the same (or about the same) as the flow area through the first and second set of flow ports 23, 25. Therefore, a pressure drop occurs in the wellbore and can be observed and recorded at the surface pressure sensors. Once this pressure drop is observed, the pump rate can be increased and the new fracture zone of interest can be hydraulic fractured.

In summary, the tool 10 reliably provides a noticeable indication at surface to an operator as to when the flow port is opened. The tool 10 includes an outer housing 20 and a sliding sleeve or inner mandrel 40 which resides within the outer housing 20. The outer housing 20 has a first and second set of flow ports 23, 25. The inner mandrel 40 moves between a first position and a third position to expose the flow ports 23, 25 to the wellbore. The first set of flow ports 23, with its smaller area relative to the second set of flow ports 25, creates a noticeable pressure increase or spike that can be observed at surface when exposed to the wellbore. The second set of flow ports 25 creates a noticeable pressure drop when it is exposed to the wellbore.

When in use and positioned downhole in a fracture zone of interest, fracture port tool 10 provides a method for detecting when the fracture zone of interest is opened and exposed to the wellbore. The method includes the steps of:

creating a first well fluid pressure within the fracture port tool 10;

creating a second well fluid pressure within the fracture port tool 10 by allowing a portion of the well fluid to exit the fracture port tool 10 and become exposed to the well bore; and creating a third well fluid pressure within the fracture port tool 10 by allowing an additional portion of the well fluid to exit the fracture port tool 10 and become exposed to the well fluid The second pressure (i.e., the noticeable pressure increase or spike) is greater than the first pressure (e.g., ambient pressure) and the third pressure (i.e., the noticeable pressure decrease).

The first well fluid pressure can be created by the fracture port tool 10 having a first position that prevents the well fluid from exiting the fracture port tool 10. The second well fluid pressure can be created by the fracture port tool 10 having a second position that allows a portion of the well fluid to exit the fracture port tool 10. The allowing means may be a first set of ports 23. The third well fluid pressure can be created by the fracture port tool 10 having a third position that allows an additional portion of the well fluid to exit the fracture port tool 10. The allowing means here may be a second set of ports 25. The portion and additional portion of the well fluid preferably exits a flow area (e.g., the area created by ports 23, 25) having substantially the same size as a flow area through the fracture port tool 10.

The preferred embodiment of the fracture port tool 10 described above is not the only possible embodiment of a pressure response fracture port tool made according to this invention or method for its use. The invention itself is defined by the following claims and includes elements which are equivalent to those listed in the claims.

What is claimed:

1. A pressure response fracture port tool comprising:

an outer housing including a first set of flow ports and a second set of flow ports, the first set of flow ports having a different flow area than the second set of flow ports;

a sliding sleeve residing within the outer housing and arranged to move in response to fluid pressure between a first, a second, and a third position relative to the first and second set of flow ports, a first fluid medium affecting a rate of travel between the first and second positions and a second different fluid medium affecting a rate of travel between the second and third positions.

2. A pressure response fracture port tool according to claim 1 wherein the second position results in a pressure increase relative to that of the first position.

3. A pressure response fracture port tool according to claim 2 wherein the pressure increase is at least about double that of an ambient pressure.

4. A pressure response fracture port tool according to claim 1 wherein the third position results in a pressure decrease relative to that of the second position.

5. A pressure response fracture port tool according to claim 1 wherein the time required to move between the first and second positions is a different time than the time required to move between the second and third positions.

6. A pressure response fracture port tool according to claim 1 wherein the distance required to move between the first and second positions is a different distance than the distance required to move between the second and third positions.

7. A pressure response fracture port tool according to claim 1 wherein in the second position the first set of flow ports is exposed to a fluid flow on a well casing ID.

8. A pressure response fracture port tool according to claim 1 wherein in the third position the second set of flow ports is exposed to a fluid flow on a well casing ID.

9. A pressure response fracture port tool according to claim 1 further comprising the sliding sleeve including a ball-receiving profile located toward one end of the sliding sleeve.

10. A pressure response fracture port tool according to claim 1 further comprising means for temporarily securing the sliding sleeve in the first position relative to the outer housing.

11. A pressure response tool according to claim 10 wherein the temporary securing means is a set of shear pins.

12. A pressure response fracture port according to claim 1, further comprising a fluid containment ring located about the sliding sleeve and configured to move with the sliding sleeve, the containment ring including bypass holes;

wherein in the first position, the first and second different fluid mediums reside below the containment ring; and wherein in the second position, the first fluid medium resides above the containment ring and the second different fluid medium resides below the containment ring.

13. A pressure response fracture port tool comprising:

an outer housing including a first set of flow ports and a second set of flow ports, the first set of flow ports having a different flow area than the second set of flow ports;

a sliding sleeve residing within the outer housing and configured to move in response to fluid pressure between a first, a second, and a third position relative to the first and second set of flow ports, means for temporarily securing the sliding sleeve in the first position relative to the outer housing;

a fluid containment ring located about the sliding sleeve and configured to move with the sliding sleeve, the containment ring including bypass holes;

a first fluid medium contained between the sliding sleeve and outer housing and, when the sliding sleeve is in the first position, located below the fluid containment ring, the height of the first fluid medium sized equal to a travel distance between the first and second positions;

a second different fluid medium contained between the sliding sleeve and the outer housing and located below the first fluid medium; the height of the second different fluid medium sized equal to a travel distance of the sliding sleeve between the second and third positions;

wherein when in the second position, the first fluid medium resides above the containment ring and the second different fluid medium resides below the containment ring.

* * * * *